US012006003B1

(12) United States Patent
Shoer

(10) Patent No.: US 12,006,003 B1
(45) Date of Patent: Jun. 11, 2024

(54) FINS FOR WATERSPORT BOARDS AND WATERSPORT BOARDS COMPRISING THE SAME

(71) Applicant: Uri Shoer, Haifa (IL)

(72) Inventor: Uri Shoer, Haifa (IL)

(73) Assignee: Uri Shoer, Haifa (IL)

( * ) Notice: Subject to any disclaimer, the term of this patent is extended or adjusted under 35 U.S.C. 154(b) by 0 days.

(21) Appl. No.: 18/367,465

(22) Filed: Sep. 13, 2023

Related U.S. Application Data

(60) Provisional application No. 63/453,204, filed on Mar. 20, 2023.

(51) Int. Cl.
*B63B 32/66* (2020.01)
*B63B 32/60* (2020.01)

(52) U.S. Cl.
CPC ..... *B63B 32/66* (2020.02); *B63B 32/60* (2020.02)

(58) Field of Classification Search
CPC ..... B63B 32/60; B63B 32/62; B63B 32/64; B63B 32/66
USPC ..... D21/769, 771, 778
See application file for complete search history.

(56) References Cited

U.S. PATENT DOCUMENTS 4,398,485 A * 8/1983 Diziere ..... B63B 32/66 441/79
5,683,280 A * 11/1997 Winner ..... B63B 32/66 114/140
6,916,220 B2 * 7/2005 Davey ..... B63B 32/66 114/127
D703,781 S * 4/2014 Durante ..... D21/778
9,725,141 B2 * 8/2017 Schultz, III ..... B63B 32/66
9,926,051 B2 * 3/2018 Miller ..... B63B 32/66
D831,144 S * 10/2018 Schuster ..... D21/778
10,654,547 B2 * 5/2020 Miller ..... B63B 32/66
D949,995 S 4/2022 Canchola et al.
2022/0111936 A1 * 4/2022 Todd ..... B63B 1/248

FOREIGN PATENT DOCUMENTS

DE 3246126 A1 * 6/1984
FR 2494210 A1 * 5/1982

OTHER PUBLICATIONS

"New Shifter Fin"; retrieved from the internet on May 30, 2023; https://quobbafins.com/collections/shifter-fin-package.

* cited by examiner

*Primary Examiner* — Ajay Vasudeva
(74) *Attorney, Agent, or Firm* — PEARL COHEN ZEDEK LATZER BARATZ LLP

(57) ABSTRACT

In a watersport board having a fin socket configured to receive a connector of a fin such that a blade of the fin is at a specified distance from a trailing end of the watersport board when the connector of the fin is mounted in the fin socket, the improvement may include an offset-adapted fin, the offset-adapted fin may include: a connector configured to be mounted in the fin socket of the watersport board; and a blade attached to the connector; wherein the blade is offset with respect to the connector in a longitudinal offset direction by an offset distance such that when the connector of the offset-adapted fin is mounted in the fin socket of the watersport board, the blade of the offset-adapted fin is distanced from the trailing end of the watersport board by a distance that is different from the specified distance by the offset distance.

6 Claims, 13 Drawing Sheets

200
*Bottom view*

200
*Side view*

SECTION AA

FINS FOR WATERSPORT BOARDS AND WATERSPORT BOARDS COMPRISING THE SAME

CROSS-REFERENCE TO RELATED APPLICATIONS

This application claims priority to U.S. Provisional Application No. 63/453,204 filed on Mar. 20, 2023, which is incorporated herein by reference in its entirety.

FIELD OF THE INVENTION

The present invention relates to the field of watersport boards, and more particularly, to fins for watersport boards.

BACKGROUND OF THE INVENTION

Typically, a watersport board (e.g., a "surfboard") has fin sockets disposed on a bottom surface of the watersport board into which fins can be mounted. The position of the fin sockets in the watersport board is typically fixed and cannot be changed for a given configuration of fin sockets once the fin is installed. Accordingly, a user of the watersport board cannot change the position of blades of the fins with respect to the watersport board and/or the relative position of the blades of the fins with respect to each other. However, the position of the blades of the fins with respect to the watersport board and/or the relative position of the blades of the fins with respect to each other can affect performance.

SUMMARY OF THE INVENTION

Some embodiments of the present invention may provide an improvement in a watersport board having a fin socket configured to receive a connector of a fin such that a blade of the fin is at a specified distance from a trailing end of the watersport board when the connector of the fin is mounted in the fin socket, the improvement may include an offset-adapted fin, which may include: a connector configured to be mounted in the fin socket of the watersport board; and a blade attached to the connector; wherein the blade is offset with respect to the connector in a longitudinal offset direction by an offset distance such that when the connector of the offset-adapted fin is mounted in the fin socket of the watersport board, the blade of the offset-adapted fin is distanced from the trailing end of the watersport board by a distance that is different from the specified distance by the offset distance.

In some embodiments, the offset is in a longitudinal trailing offset direction such that when the connector of the offset-adapted fin is mounted in the fin socket of the watersport board, the blade of the offset-adapted fin is distanced from the trailing end of the watersport board by a distance that is smaller than the specified distance.

In some embodiments, the offset is in a longitudinal leading offset direction such that when the connector of the offset-adapted fin is mounted in the fin socket of the watersport board, the blade of the offset-adapted fin is distanced from the trailing end of the watersport board by a distance that is greater than the specified distance.

In some embodiments, the offset distance is 1/64 inch or more.

In some embodiments, the offset distance is 2.5 inches or less.

In some embodiments, wherein the connector of the offset-adapted fin includes a leading end and a trailing end, the connector extending in a longitudinal direction between the leading end and the trailing end; wherein blade of the offset-adapted fin includes: a base edge attached to the connector, a leading edge meeting the base edge at a leading point, and a trailing edge meeting the base edge at a trailing point; and wherein the leading point of the blade of the offset-adapted fin is offset from the leading end of the connector of the offset-adapted fin in the longitudinal offset direction and the trailing point of the blade of the offset-adapted fin is offset from the trailing end of the connector of the offset-adapted fin in the same longitudinal offset direction.

Some embodiments of the present invention may provide a set of offset-adapted fins for a watersport board, the set may include: a plurality of offset-adapted fins, each offset-adapted fin of the plurality of offset-adapted fins including: a connector configured to be mounted in a fin socket of the watersport board, and a blade attached to the connector, the blade being offset with respect to the connector in a longitudinal offset direction by an offset distance; wherein the offset distance, the longitudinal offset direction or both of at least one offset-adapted fin of the plurality of offset-adapted fins is different from the offset distance, the longitudinal offset direction or both of at least one another offset-adapted fin of the plurality of offset-adapted fins.

In some embodiments, at least two offset-adapted fins of the plurality of offset-adapted fins have the same offset distance.

In some embodiments, at least two offset-adapted fins of the plurality of offset-adapted fins have the same longitudinal offset direction.

In some embodiments, at least two offset-adapted fins of the plurality of offset-adapted fins have the same offset distance and the same longitudinal offset direction.

In some embodiments, at least two offset-adapted fins of the plurality of offset-adapted fins have the same offset distance and different longitudinal offset directions.

In some embodiments, at least two offset-adapted fins of the plurality of offset-adapted fins have the same longitudinal offset direction and different offset distances.

Some embodiments of the present invention may provide a watersport board including the set of offset-adapted fins described herein.

Some embodiments of the present invention may provide a method of aligning a watersport board, which may include: providing a watersport board including a fin socket, the fin socket being disposed at a fixed distance relative to a trailing end of the watersport board; providing a plurality of offset-adapted fins, each offset-adapted fin of the plurality of offset-adapted fins including: a connector configured to be mounted in the fin socket of the watersport board, and a blade attached to the connector, the blade being offset with respect to the connector in a longitudinal offset direction by an offset distance, wherein the offset distance, the longitudinal offset direction or both of at least one offset-adapted fin of the plurality of offset-adapted fins is different from the offset distance, the longitudinal offset direction or both of at least one another offset-adapted fin of the plurality of offset-adapted fins; selecting an offset-adapted fin from the plurality of offset-adapted fins based on a desired distance of the blade of the selected offset-adapted fin from the trailing end of the watersport board; and mounting the connector of the selected offset-adapted fin in the fin socket of the watersport board.

In some embodiments, the watersport board includes two or more fin sockets, and the method may include: selecting two or more offset-adapted fin of the plurality of offset-adapted fins, each of the two or more selected offset-adapted fins for one of the two or more fin sockets; and mounting each of the two or more selected offset-adapted fins in the respective fin socket of the two or more fin sockets.

In some embodiments, the method may include selecting the desired distance of the blade of the selected offset-adapted fin from the trailing end of the watersport board based on a desired performance of the watersport board.

In some embodiments, the desired performance includes a desired stability, a desired speed and a desired turnability.

In some embodiments, the method may include selecting the desired distance of the blade of the selected offset-adapted fin from the trailing end of the watersport board based on user parameters.

In some embodiments, the user parameters comprise a height of the user, a weight of the user and a skill of the user.

In some embodiments, the method may include selecting the desired distance of the blade of the selected offset-adapted fin from the trailing end of the watersport board based on wind conditions, waves conditions or both.

BRIEF DESCRIPTION OF THE DRAWINGS

For a better understanding of embodiments of the invention and to show how the same can be carried into effect, reference is made, purely by way of example, to the accompanying drawings in which like numerals designate corresponding elements or sections throughout. In the accompanying drawings.

Figure 1B:
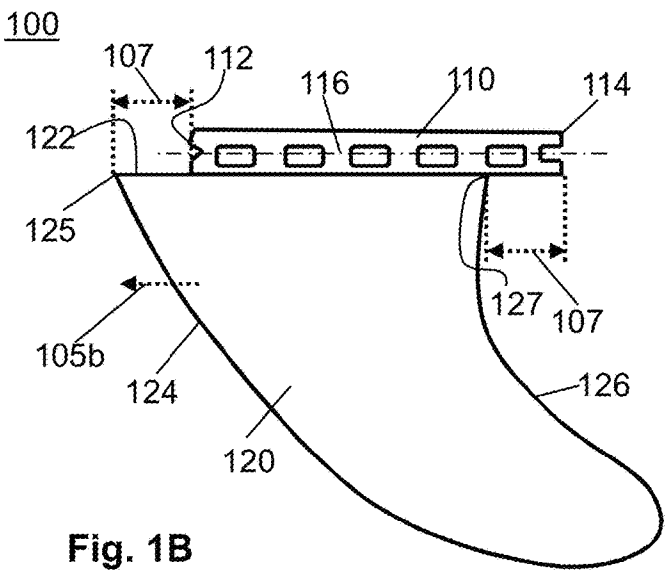
FIGS. 1A and 1B are schematic illustrations of an offset-adapted fin, according to some embodiments of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

Embodiments of the present invention may provide an improvement to a watersport board having a fixed fin socket, wherein the position of the fixed fin socket cannot be changed relative to a trailing end of the watersport board and wherein the fin socket may receive a connector of a fin such that a blade of a fin is disposed at a specified distance from the trailing end of the watersport board when a connector of the fin is mounted in the fin socket.

The improvement may include an offset-adapted fin. The offset-adapted fin may include a connector that may be mounted in the fin socket of the watersport board. The offset-adapted fin may include a blade attached to the connector. The blade of the offset-adapted fin may be offset with respect to the connector of the offset-adapted fin in a longitudinal offset direction by an offset distance. When the connector of the offset-adapted fin is mounted in the fin socket of the watersport board, the blade of the offset-adapted fin may be distanced from the trailing end of the watersport board by a distance that is different from the specified distance by the offset distance.

The offset-adapted fins according to embodiments of the present invention may allow adjusting the position of the blades of the fins in the watersport board having fixed fins sockets to optimize and/or improve the performance (e.g., a speed, a stability and/or a turnability) of the watersport board in accordance with user parameters (e.g., skill, height, weight and/or preferences) and/or wave conditions and/or wind conditions.

Figure 1A:
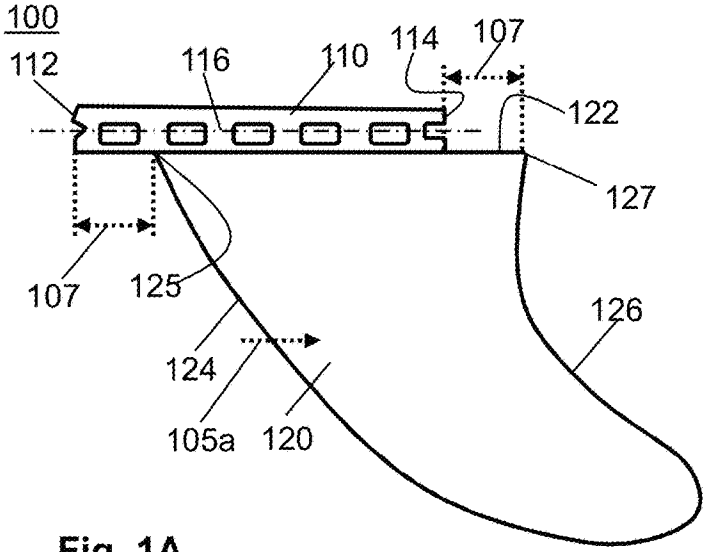

Reference is made to FIGS. 1A and 1B, which are schematic illustrations of an offset-adapted fin 100, according to some embodiments of the invention.

Figure 1C:
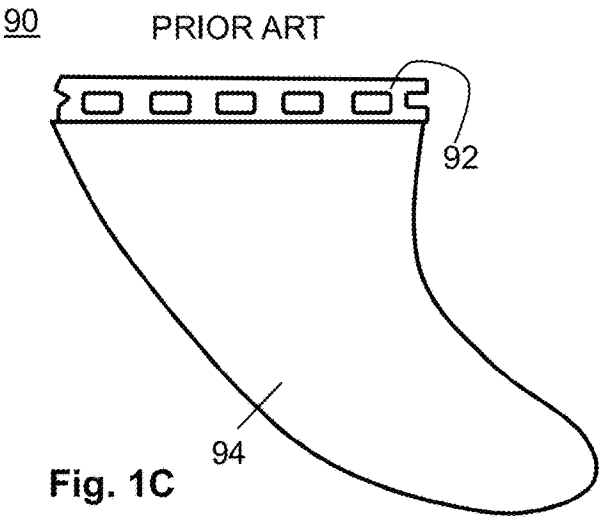
FIG. 1C is a schematic illustration of typical prior art fin.

Reference is also made to FIG. 1C, which is a schematic illustration of typical prior art fin 90.

Offset-adapted fin 100 may include a connector 110. Connector 110 may be mounted in a fin socket of a watersport board to attach offset-adapted fin 100 to the watersport board. Connector 110 may have a leading end 112 and a trailing end 114. Leading end 112 of connector 110 may face a leading end of the watersport board when connector 110 is mounted within the fin socket of the watersport board. Trailing end 114 of connector 110 may face a trailing end of the watersport board when connector 110 is mounted within the fin socket of the watersport board. Connector 110 may extend along a longitudinal axis 116 extending between leading end 112 and trailing end 114 of connector 110.

Offset-adapted fin 100 may include a blade 120. Blade 120 may be attached to connector 110. Blade 120 may extend from connector 110. Connector 110 and blade 120 may be formed integrally of one piece of material (e.g., such as polyester, epoxy and/or any other suitable material). Blade 120 may include a base edge 122. Base edge 122 may be attached to connector 110. Blade 120 may include a leading edge 124. Leading edge 124 of blade 120 may face the leading end of the watersport board when offset-adapted fin 100 is mounted within the fin socket of the watersport board. Leading edge 124 of blade 120 may meet base edge 122 of blade 120 at a leading point 125. Blade 120 may include a trailing edge 126. Trailing edge 126 of blade 120 may face the training end of the watersport board when fin 100 is mounted within the fin socket of the watersport board. Trailing edge 126 of blade 120 may meet base edge 122 of blade 120 at a trailing point 127.

Blade 120 may be offset with respect to connector 110 of offset-adapted fin 100 in a longitudinal offset direction. The longitudinal offset direction may be parallel to longitudinal axis 116 of connector 110. Leading point 125 of leading edge 122 of blade 120 may be offset (e.g., distanced) from leading end 112 of connector 110 in the longitudinal offset direction. Trailing point 127 of trailing edge 126 of blade 120 may be offset (e.g., distanced) from trailing end 114 of connector 110 in the longitudinal offset direction. Leading point 125 of leading edge 122 and trailing point 127 of trailing edge 126 of blade 120 may be offset (e.g., distanced) from leading end 112 and trailing end 114, respectively, of connector 110 in the same longitudinal offset direction.

In the example of FIG. 1A, blade 120 is offset with respect to connector 110 in a trailing (e.g., rear) longitudinal offset direction 105*a* extending from leading end 112 towards trailing end 114 of connector 110. In the example of FIG. 1B, blade 120 is offset with respect to connector 110 in a leading (e.g., forward) longitudinal offset direction 105*b* extending from trailing end 114 towards leading end 112 of connector 110. The offset (e.g., indicated by an offset distance 107 in FIGS. 1A-1B) may be, for example, 1/64 inch or more. The offset (e.g., indicated by offset distance 107 in FIGS. 1A-1B) may be, for example, 2.5 inches or less. Offset distance 107 may be measured between leading point 125 of blade 120 and leading end 112 of connector 110. Offset distance 107 may be measured between trailing point 127 of blade 120 and trailing end 114 of connector 110.

Figure 2A:
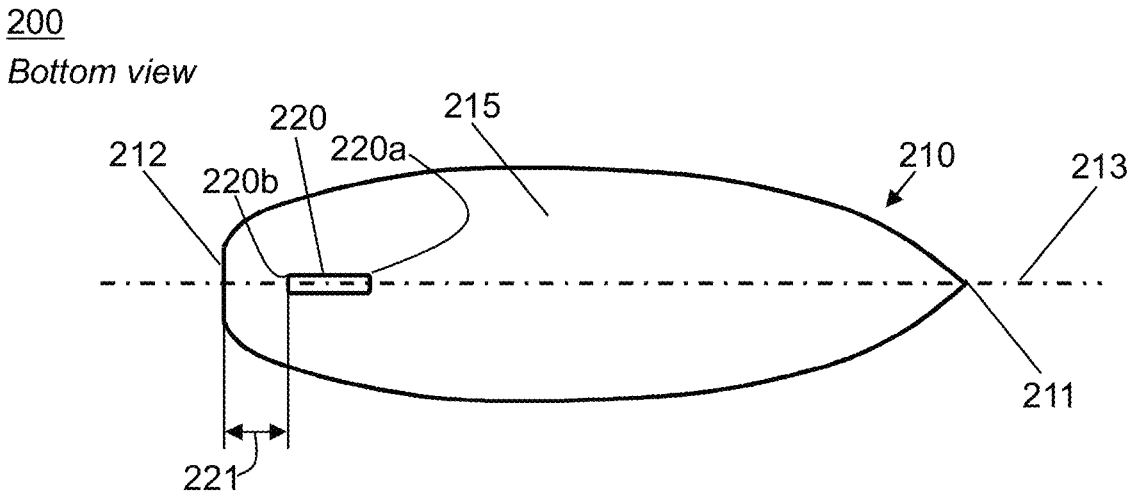
FIGS. 2A and 2B are schematic illustrations of a watersport board, according to some embodiments of the invention.
Figure 2B:
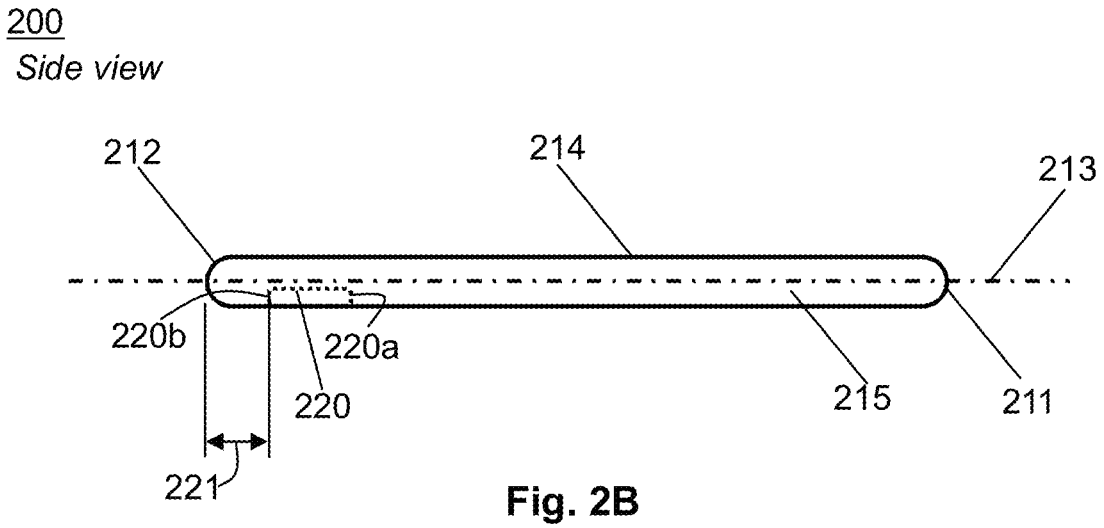

Reference is made to FIGS. 2A and 2B, which are schematic illustrations of a watersport board 200, according to some embodiments of the invention.

FIG. 2A shows a schematic top view of watersport board 200. FIG. 2B shows a schematic side view of watersport board 200.

Watersport board 200 may include an elongated body 210. Elongated body 210 may include a leading end 211, a trailing end 212, a central longitudinal axis 213 extending between leading end 211 and trailing end 212, a top surface 214 and a bottom surface 215. In use, the user may stand on top surface 214 of watersport board 210 while bottom surface 215 of watersport board 210 may face the water.

Watersport board 200 may include a fin socket 220 formed on bottom surface 215 of watersport board 200. Fin socket 220 may include a leading end 220*a* facing leading end 211 of elongated body 210 of watersport board 200 and a trailing end 220*b* facing trailing end 212 of elongated body 210 of watersport board 200.

Fin socket 220 may be fixed. The position of fin socket 220 with respect to elongated body 210 of watersport board 200 cannot be changed. Fin socket 220 may be disposed at a distance 221 from trailing end 212 of elongated body 210 of watersport board 200. Distance 221 may be measured, for example, between trailing end 212 of elongated body 210 of watersport board 200 and trailing end 220*b* of fin socket 220. Distance 221 may be fixed. Distance 221 cannot be changed.

Reference is made to FIGS. 2C-2D and FIGS. 2E-2F, which are schematic illustrations of a trailing portion of watersport board 200, offset-adapted fin 100 and typical prior art fin 90, according to some embodiments of the invention.

Figure 2C:
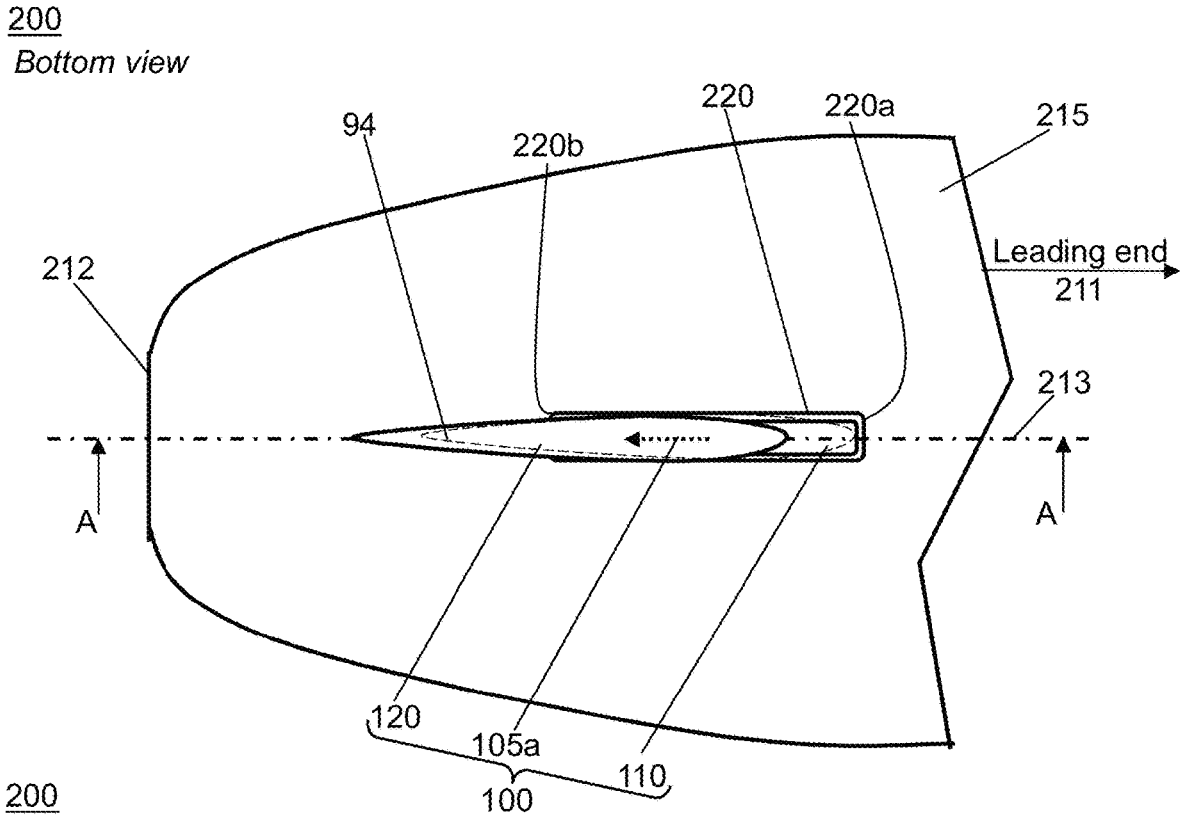
FIGS. 2C-2D and FIGS. 2E-2F are schematic illustrations of a trailing portion of the watersport board, the offset-adapted fin and typical prior art fin, according to some embodiments of the invention.
Figure 2D:
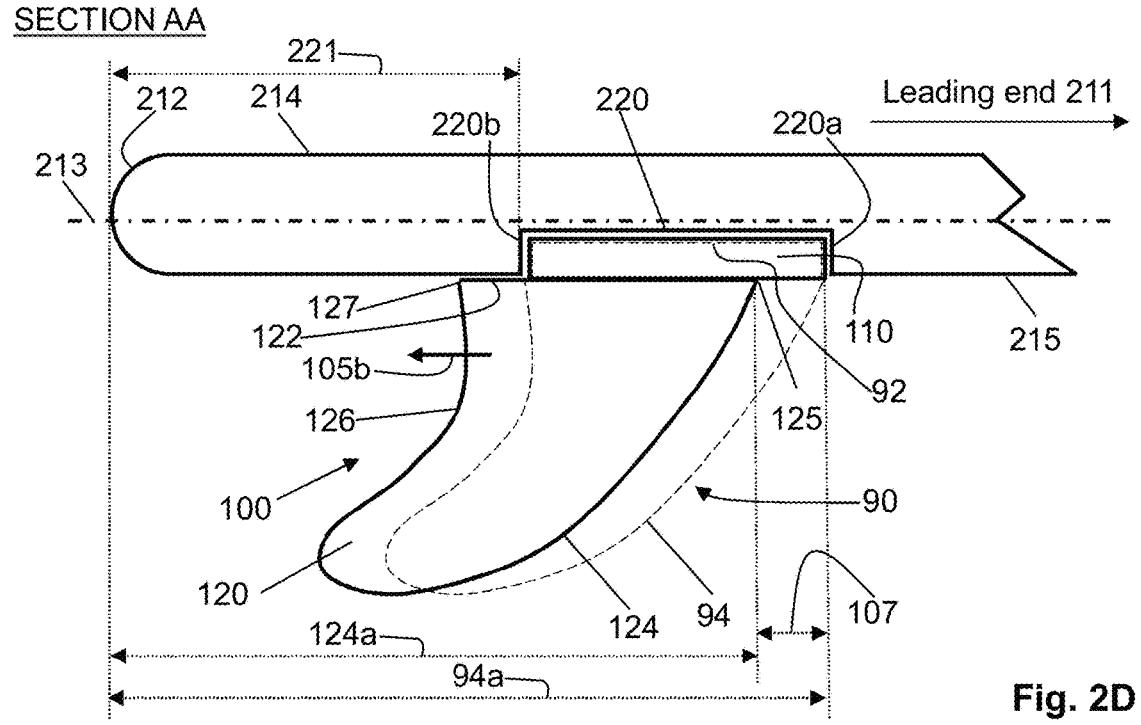
Figure 2E:
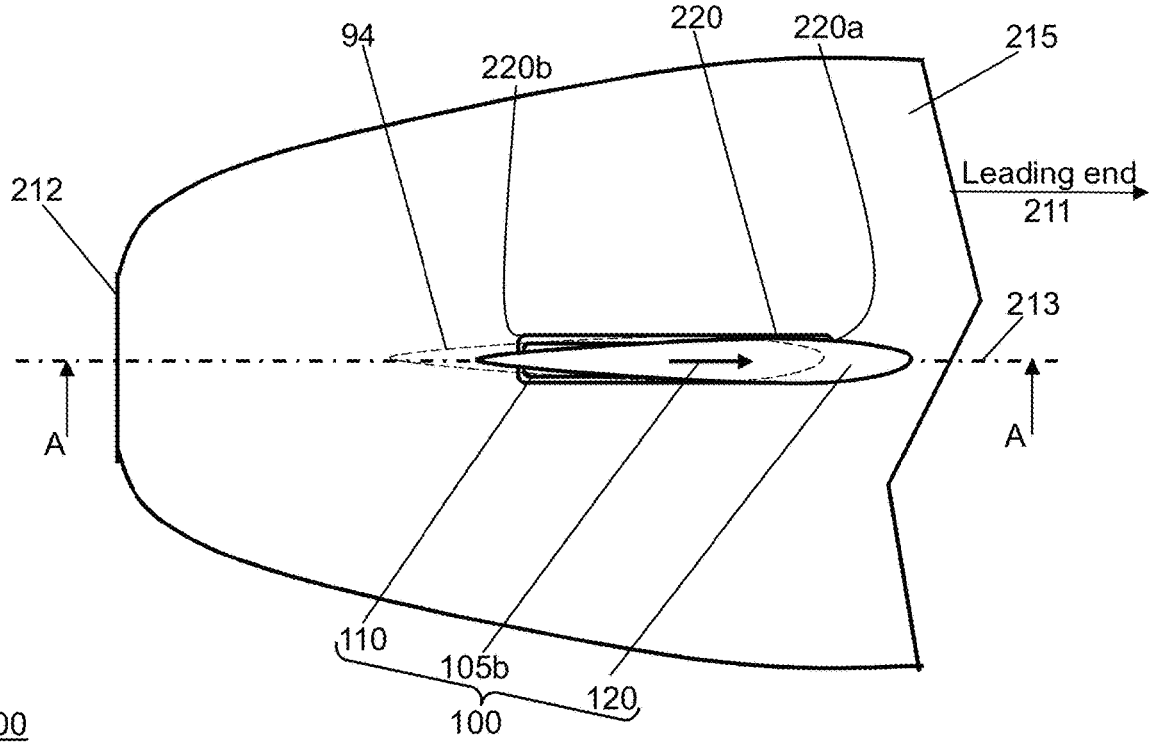
Figure 2F:
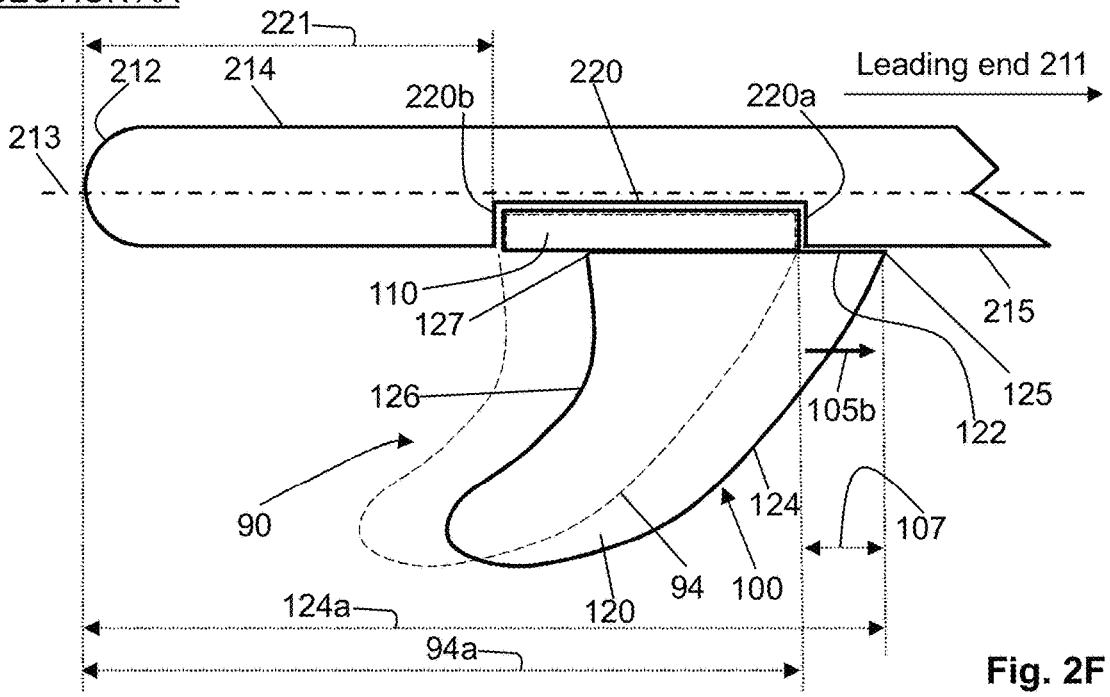

FIGS. 2C, 2E show schematic bottom views and FIGS. 2D, 2F show schematic sectional views along line AA of FIGS. 2C, 2E.

Distance 221 of fin socket 220 from trailing end 212 of elongated body 210 of watersport board 200 may be predefined (e.g., prior to manufacturing of watersport board 200) to position blade 94 of typical prior art fin 90 at a specified distance 94*a* from trailing end 212 of elongated body 210 of watersport board 200 when a connector 92 of typical prior art fin 90 is mounted in fin socket 220. Typical prior art fin 90 is shown in FIGS. 2C-2D and FIGS. 2E-2F by dashed lines. For example, the Table below shows standard distances (e.g., specified distances 94*a*) of blades of typical prior art fins (e.g., such as typical prior art fin 90) from a trailing end of a watersport board for different lengths of watersport boards:

| Watersport board length [ft] | Distance of back fin from trailing end of the watersport board [inch] | Distance of forward fins from trailing end of the watersport board [inch] |
|---|---|---|
| 6.25 | 3.645833 | 11.71875 |
| 6.5 | 3.791667 | 12.1875 |
| 6.75 | 3.9375 | 12.65625 |
| 7 | 4.083333 | 13.125 |
| 7.25 | 4.2298167 | 13.59375 |
| 7.5 | 4.375 | 14.0625 |
| 7.75 | 4.520833 | 14.53125 |
| 8 | 4.666667 | 15 |
| 8.25 | 4.8125 | 15.46875 |
| 8.5 | 4.958333 | 15.9375 |
| 8.75 | 5.104167 | 16.40625 |

As described hereinabove, in offset-adapted fin 100, blade 120 is offset relative to connector 110 in the longitudinal offset direction. Accordingly, when offset-adapted fin 100 is mounted in fin socket 220 using connector 110, blade 120 of offset-adapted fin 100 is disposed at a distance 120*a* (e.g., measured between leading point 125 of blade 120 and trailing end 212 of elongated body 210) that may be different by an offset distance 107 from specified distance 94*a* at which blade 94 of typical prior art fin 90 would be disposed if typical prior art fin 90 would have been mounted in fin socket 220.

In the example of FIGS. 2C-2D, blade 120 of offset-adapted fin 100 is offset relative to connector 110 in trailing longitudinal direction 105*a*. In this example, when connector 110 is mounted in fin socket 220, blade 120 of offset-adapted fin 100 may be disposed closer to trailing end 212 of elongated body 210 than would be disposed blade 94 of typical prior art fin 90 if typical prior art fin 90 would have been mounted in fin socket 220.

In the example of FIGS. 2E-2F, blade 120 of offset-adapted fin 100 is offset relative to connector 110 in leading longitudinal offset direction 105*b*. In this example, when connector 110 is mounted in fin socket 220, blade 120 of offset-adapted fin 100 may be disposed farther from trailing end 212 of elongated body 210 than would be disposed blade 94 of typical prior art fin 90 if typical prior art fin 90 would have been mounted in fin socket 220.

While fin socket 220 is shown in FIGS. 2A-2F as a central fin socket and offset-adapted fin 100 as a central fin disposed along central longitudinal axis 213 of elongated body 210 of watersport board 200, fin socket 220 may be any one of side fin sockets and offset-adapted fin 100 may be any one of offset-adapted side fins (e.g., as described hereinbelow).

Figure 3:
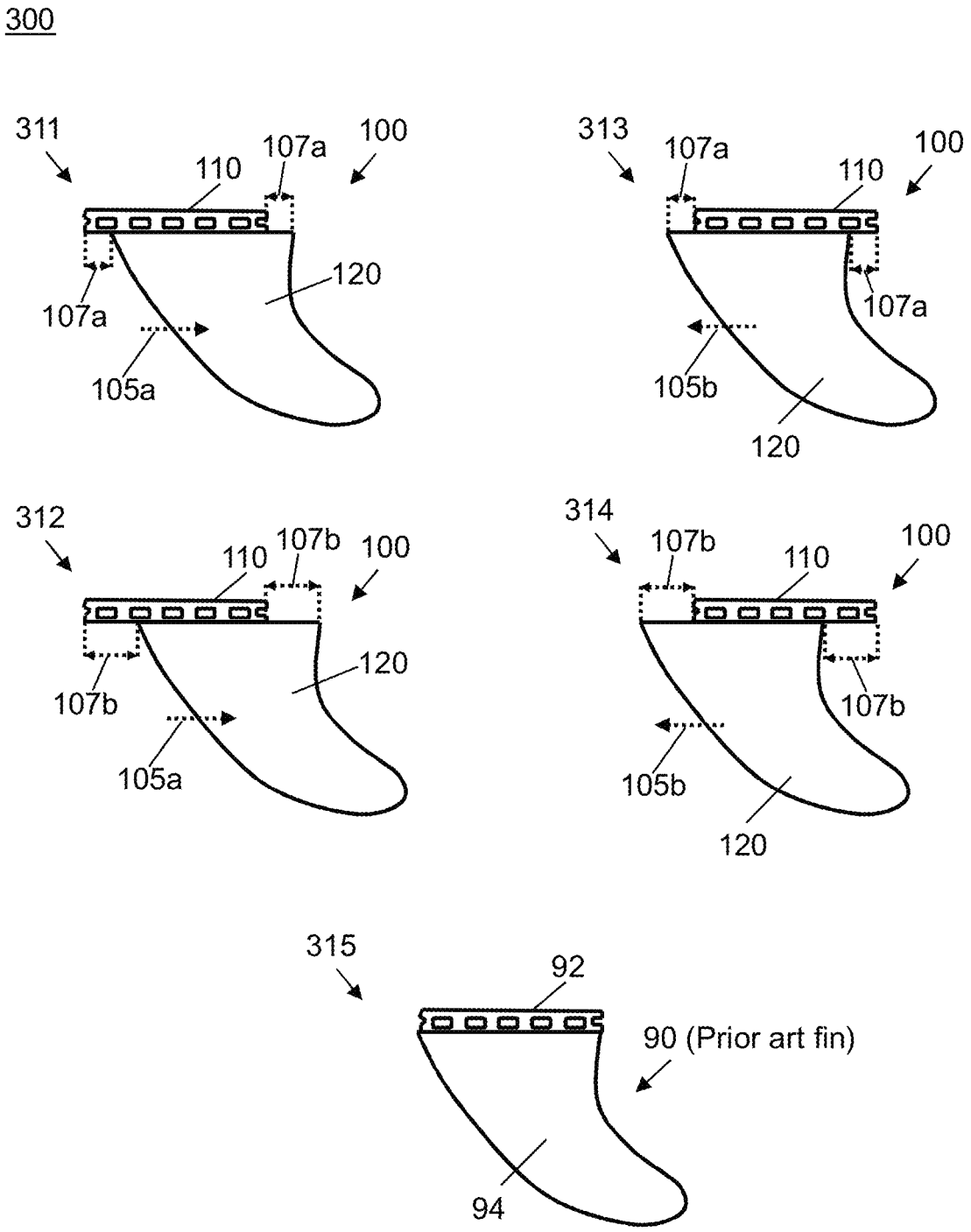
FIG. 3 is a schematic illustration of a set of offset-adapted fins, according to some embodiments of the invention.

Reference is made to FIG. 3, which is a schematic illustration of a set 300 of offset-adapted fins 100, according to some embodiments of the invention.

Set 300 may include a plurality of offset-adapted fins 100. In set 300, offset distance 107 and/or the longitudinal offset direction (e.g., longitudinal offset directions 105*a*, 105*b*) of at least one offset-adapted fin 100 of the plurality of offset-adapted fins 100 of set 300 may be different from offset distance 107 and/or the longitudinal offset direction of at least one another offset-adapted fin 100 of the plurality of offset-adapted fins 100 of set 300. In some embodiments, at least two offset-adapted fins 100 of set 300 may have the same offset distance. In some embodiments, at least two offset-adapted fins 100 of set 300 may have the same longitudinal offset direction. In some embodiments, at least two offset-adapted fins 100 of set 300 have the same offset distance and the same longitudinal offset direction. In some embodiments, at least two offset-adapted fins 100 of set 300 may have the same offset distance and different longitudinal offset directions. In some embodiments, at least two offset-adapted fins 100 of set 300 may have the same longitudinal offset direction and different offset distances.

In the example of FIG. 3, set 300 includes a first subset 311 of offset-adapted fins 100, a second subset 312 of offset-adapted fins 100, a third subset 313 of offset-adapted fins 100 and a fourth subset 314 of offset-adapted fins 100. In first subset 311, blade 120 of each offset-adapted fin 100 may be offset with respect to its respective connector 110 in trailing longitudinal direction 105*a* by a first offset distance 107*a*. In second subset 312, blade 120 of each offset-adapted fin 100 may be offset with respect to its respective connector 110 in trailing longitudinal direction 105*a* by a second offset distance 107*b*. In third subset 313, blade 120 of each offset-adapted fin 100 may be offset with respect to its connectors 110 in leading longitudinal offset direction 105*b* by first offset distance 107*a*. In fourth subset 314, blade 120 of each offset-adapted fin 100 may be offset with respect to its connectors 110 in leading longitudinal offset direction 105*b* by second offset distance 107*b*. Each of subsets 311 to 314 may include more than one offset-adapted fins 100. For example, each of subsets 311 to 314 may include two, three, four, five and/or any other suitable number of offset-adapted fins. While four subsets 211 to 214 of offset-adapted fins 100 are shown in FIG. 3, set 300 may include any other suitable number of subsets of offset-adapted fins 100 (e.g., one, two, three, five or more subsets of offset-adapted fins 100). Set 300 may include a fifth subset 315 of typical prior art fins 90.

Unlike as with typical prior art fin 90 the blade 94 of which may be disposed only at specified distance 94*a* from trailing end 212 of elongated body 210 of watersport board 200, with set 300 then user may select offset-adapted fin 100 with the desired offset direction (e.g., trailing longitudinal offset direction 105*a* or leading longitudinal offset direction 105*b*) and/or the desired offset distance (e.g., offset distance 107) of blade 120 relative to connector 110, the user may adjust the distance of blade 120 of offset-adapted fin 100 from trailing end 212 of elongated body 210 of watersport board 200 (e.g., as described hereinabove with respect to FIGS. 2C-2D and FIGS. 2E-2F). Adjusting the distance of blade 120 of offset-adapted fin 100 from trailing end 212 of elongated body 210 of watersport board 200 may optimize and/or improve the performance of watersport board 200 in accordance with the user parameters and/or wind conditions and/or wave conditions.

Figure 4A:
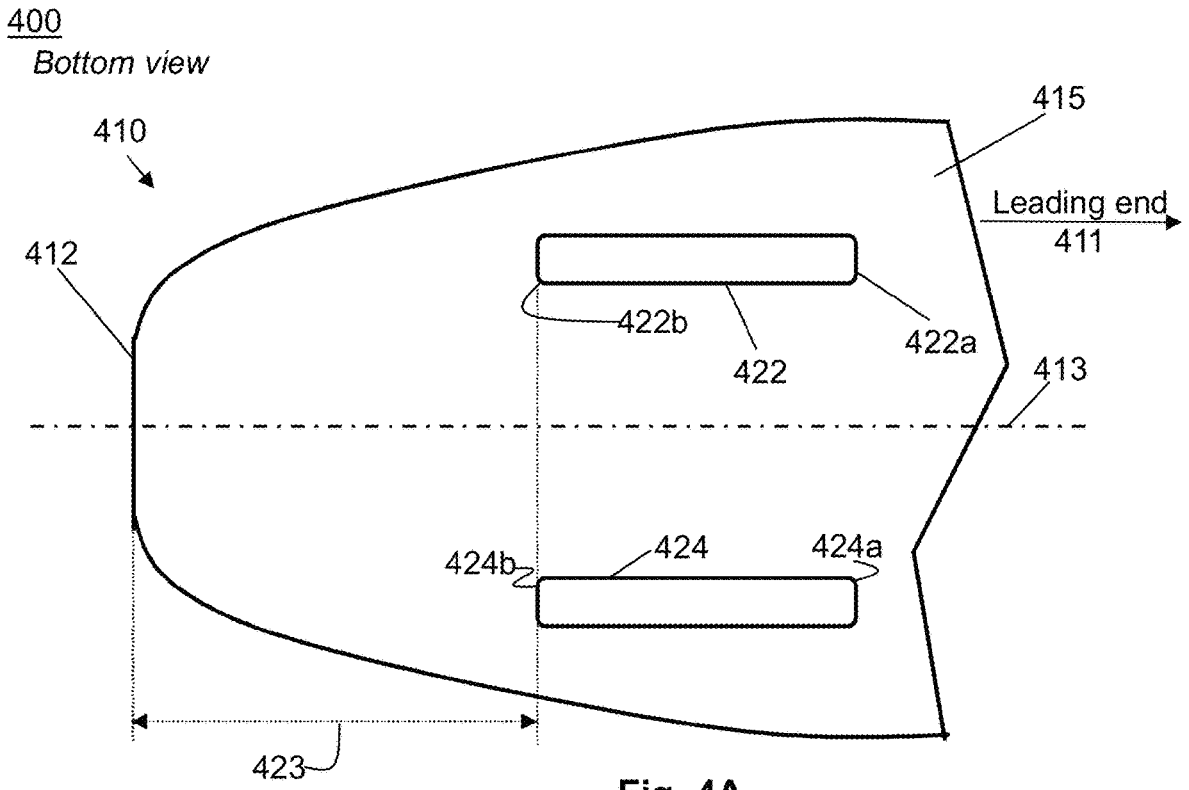
FIG. 4A is a schematic illustration of a trailing portion of a watersport board including two side fin sockets, according to some embodiments of the invention.

Reference is made to FIG. 4A, which is a schematic illustration of a trailing portion of a watersport board 400 including two side fin sockets 422, 424, according to some embodiments of the invention.

FIG. 4A shows a schematic bottom view of the trailing portion of an elongated body 410 of watersport board 400, including a bottom surface 415, a trailing end 412 and a central longitudinal axis 413 extending between trailing end 412 and a leading end 411 of watersport board 400.

Watersport board 400 may include a first side fin socket 422 and a second side fin socket 424 formed on bottom surface 415 of elongated body 410 of watersport board 400. First side fin socket 422 and second side fin socket 424 may be disposed on opposing sides of central longitudinal axis 413 of elongated body 410 of watersport board 400. First side fin socket 422 may include a leading end 422*a* facing leading end 411 and a trailing end 422*b* facing trailing end 412 of elongated body 410 of watersport board 400. Second side fin socket 424 may include a leading end 424*a* facing leading end 411 and a trailing end 424*b* facing trailing end 412 of elongated body 410 of watersport board 400. First side fin socket 422 and second side fin socket 424 may be disposed at the same distance 423 from trailing end 412 of elongated body 410 of watersport board 400. Distance 423 may be measured between trailing ends 422*b*, 424*b* of first fin socket 422 and second fin socket 424, respectively and trailing end 412 of elongated body 410 of watersport board 400. First side fin socket 422 and second side fin socket 424 may be fixed (e.g., distance 423 cannot be changed). While shown as parallel to central longitudinal axis 413, first side socket 422 and second side socket 424 may each be disposed at a certain angle with respect to central longitudinal axis 413 of elongated body 410 of watersport board 400, for example such that longitudinal axes of first side socket 422 and second side socket 424 meet at a leading point at leading end 411 of elongated body 410 of watersport board 400.

Figure 4B:
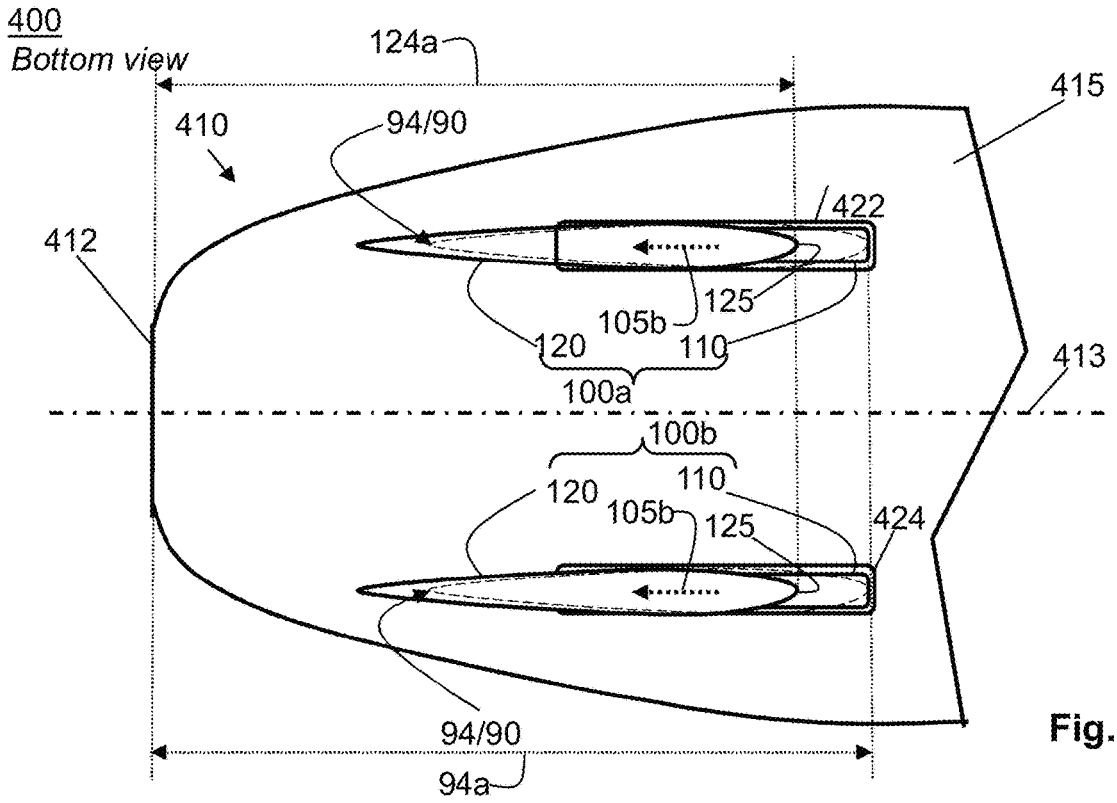
FIGS. 4B and 4C are schematic illustrations of the trailing portion of watersport board of FIG. 4A, two offset-adapted side fins and two typical prior art fins, according to some embodiments of the invention.
Figure 4C:
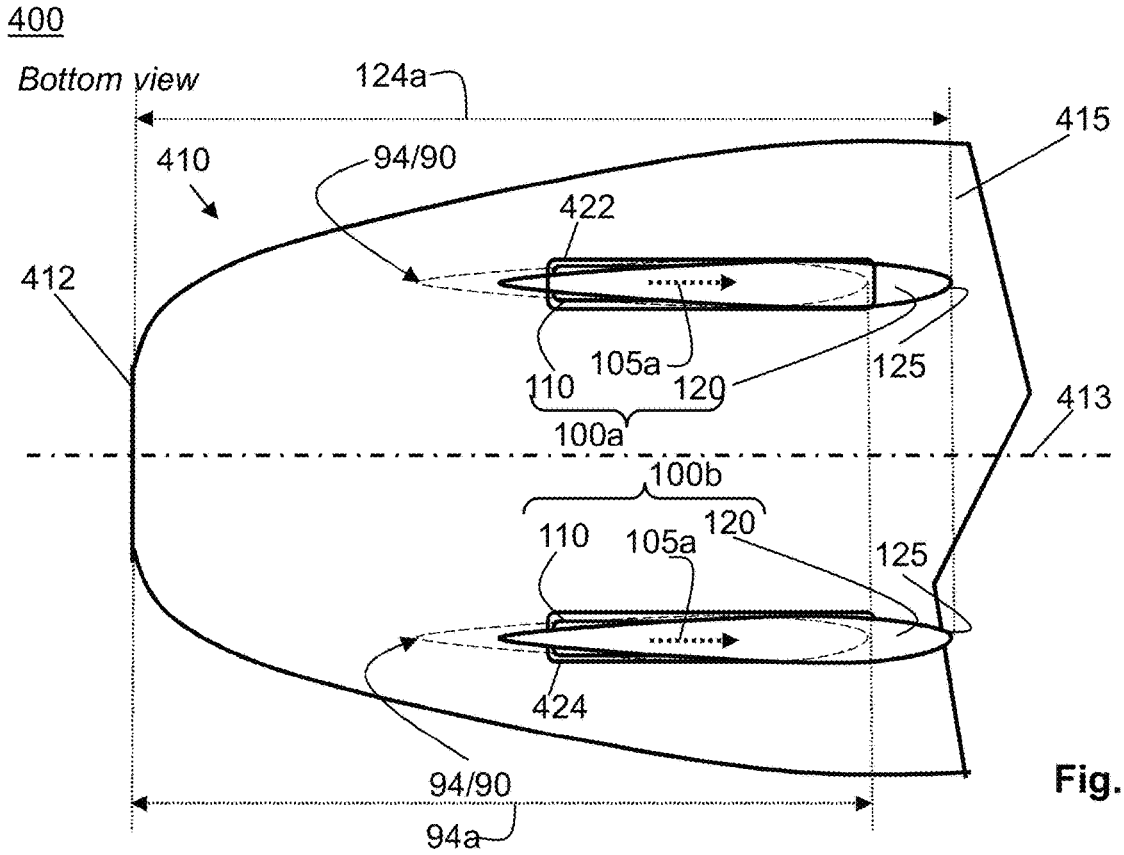

Reference is made to FIGS. 4B and 4C, which are schematic illustrations of the trailing portion of watersport board 400 of FIG. 4A, two offset-adapted side fins 100*a*,

100*b* and two typical prior art fins 90, according to some embodiments of the invention.

FIGS. 4B, 4C and 4D show the schematic bottom view of the trailing portion of elongated body 410 of watersport board 400.

Unlike as with typical prior art fins 90 the blade 94 of which may be disposed only at specified distance 94*a* from trailing end 212 of elongated body 210 of watersport board 200, with set 300 of offset-adapted fins 100 the user may select each of offset-adapted side fins 100*a*, 100*b* based on the desired distance of blade 120 of the respective offset-adapted side fin 100*a*, 100*b* from trailing end 412 of watersport board 400.

In the example of FIG. 4B, blades 120 of first offset-adapted side fin 100*a* and second offset-adapted side fin 100*b* are offset relative to their respective connectors 110 in trailing longitudinal offset direction 105*a*. In this example, when connectors 110 of first offset-adapted side fin 100*a* and second offset-adapted side fin 100*b* are mounted in first side fin socket 422 and second side fin socket 424, respectively, blades 120 of first offset-adapted side fin 100*a* and second offset-adapted side fin 100*b* may be disposed closer to trailing end 412 of elongated body 410 than would be disposed blades 94 of typical prior art fins 90 if typical prior art fins 90 would have been mounted in first side fin socket 422 and second side fin socket 424.

In the example of FIG. 4C, blades 120 of first offset-adapted side fin 100*a* and second offset-adapted side fin 100*b* are offset relative to their respective connectors 110 in leading longitudinal offset direction 105*b*. In this example, when connectors 110 of first offset-adapted side fin 100*a* and second offset-adapted side fin 100*b* are mounted in first side fin socket 422 and second side fin socket 424, respectively, blades 120 of first offset-adapted side fin 100*a* and second offset-adapted side fin 100*b* may be disposed farther from trailing end 412 of elongated body 410 than would be disposed blades 94 of typical prior art fins 90 if typical prior art fins 90 would have been mounted in first side fin socket 422 and second side fin socket 424.

In the examples of FIGS. 4B and 4C, blades 120 of first offset-adapted side fin 100*a* and second offset-adapted side fin 100*b* are disposed at the same distance 124*a* from trailing end 412 of elongated body 410 of watersport board 400. Distance 124*a* may be measured from leading point 125 of leading edge 124 of blade 120 of the respective first offset-adapted side fin 100*a* and second offset-adapted side fin 100*b*.

Watersport board 400 may include a central fin socket that may receive a central offset-adapted fin (e.g., as described above with respect to FIGS. 2A, 2B, 2C, 2D, 2E and 2F). Watersport board 400 may include four side fin sockets that may receive four offset-adapted side fins.

Reference is made to FIGS. 5A-5B, FIGS. 5D-5E and FIGS. 5G-5H, which are schematic illustrations of a trailing portion of a watersport board 500 and at least one offset-adapted fin 100, according to some embodiments of the invention.

Figures 5A, 5B, 5C:
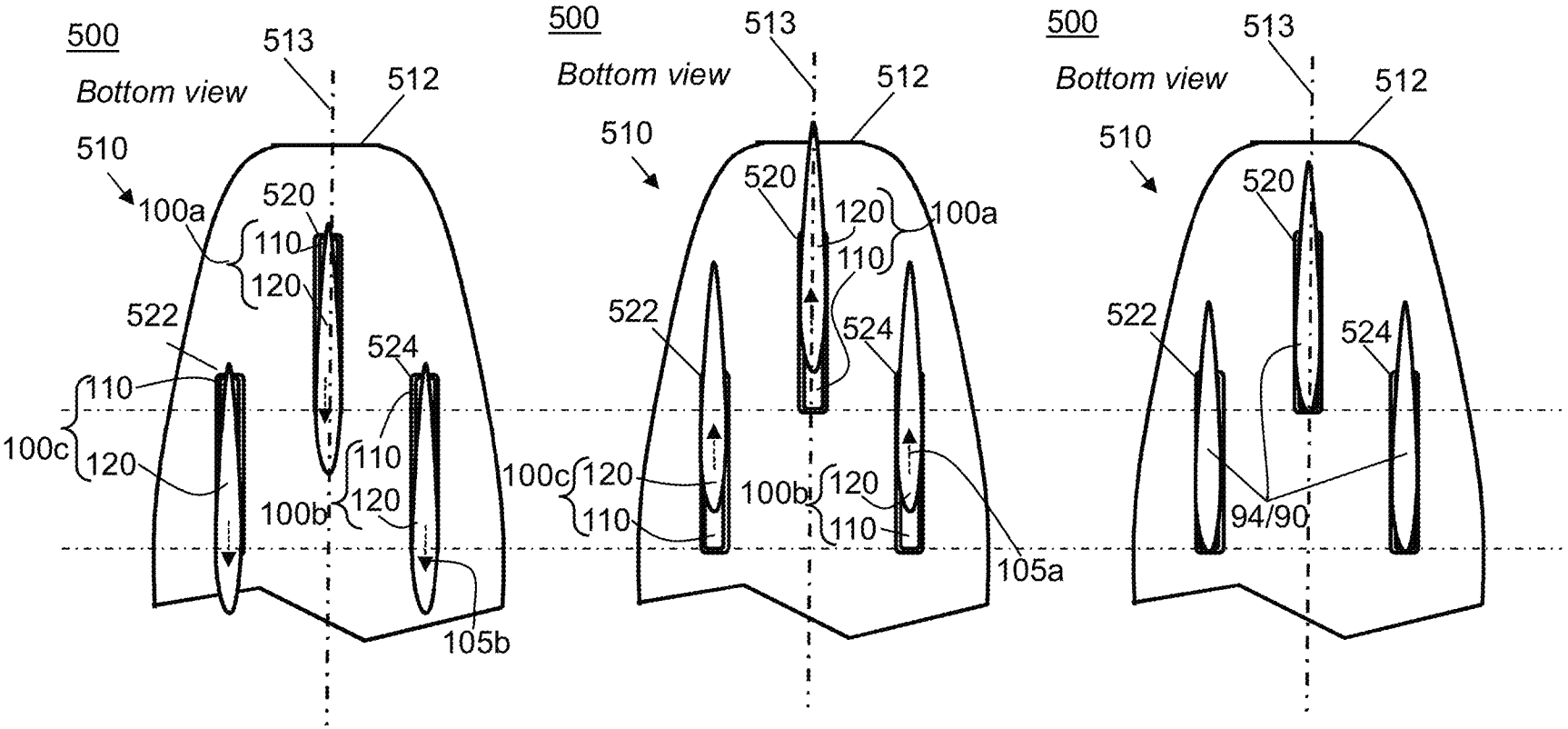
FIGS. 5A-5B, FIGS. 5D-5E and FIGS. 5G-5H are schematic illustrations of a trailing portion of a watersport board and at least one offset-adapted fin, according to some embodiments of the invention.
FIG. 5C, 5F, 5I are schematic illustration of the trailing portion of the watersport board and three typical prior art fins.
Figures 5D, 5E, 5F:
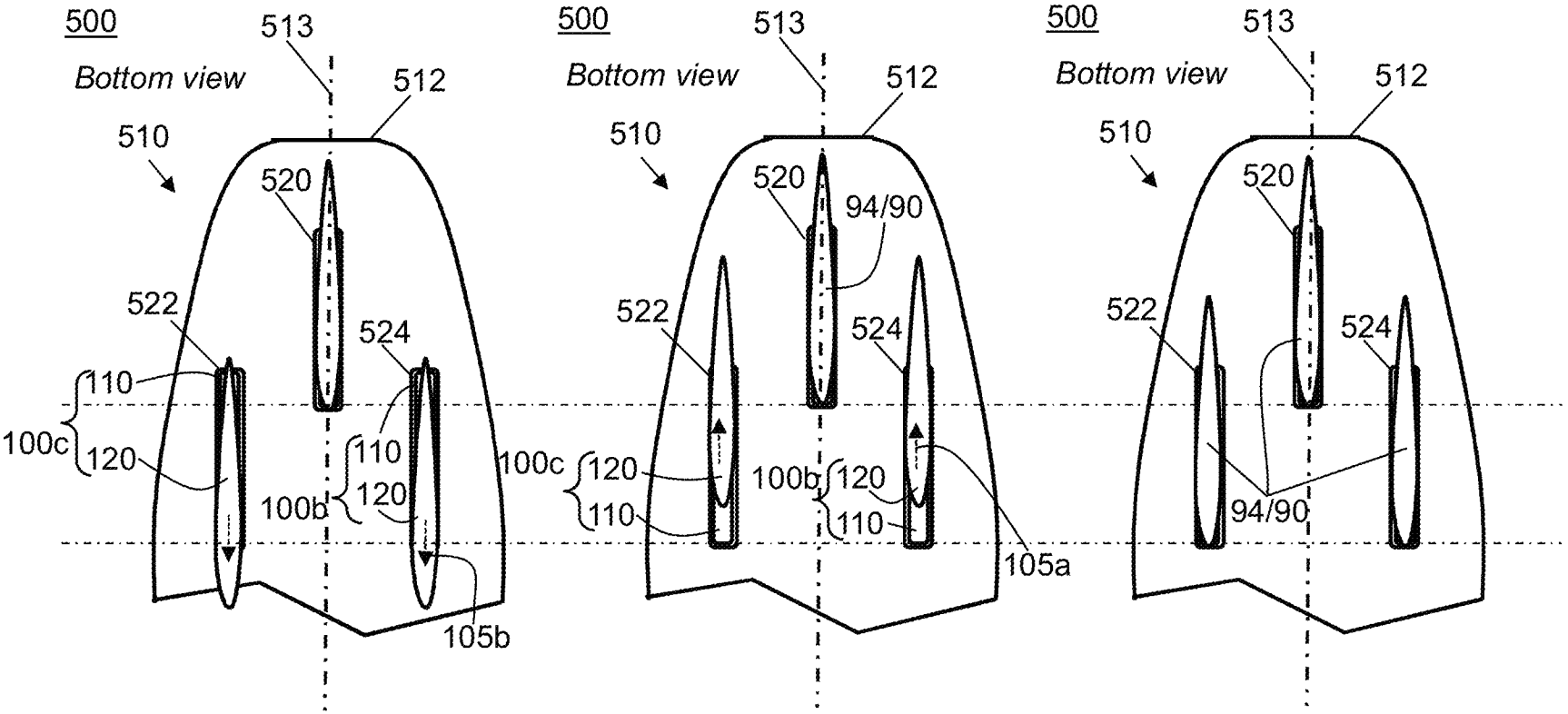
Figures 5G, 5H, 5I:
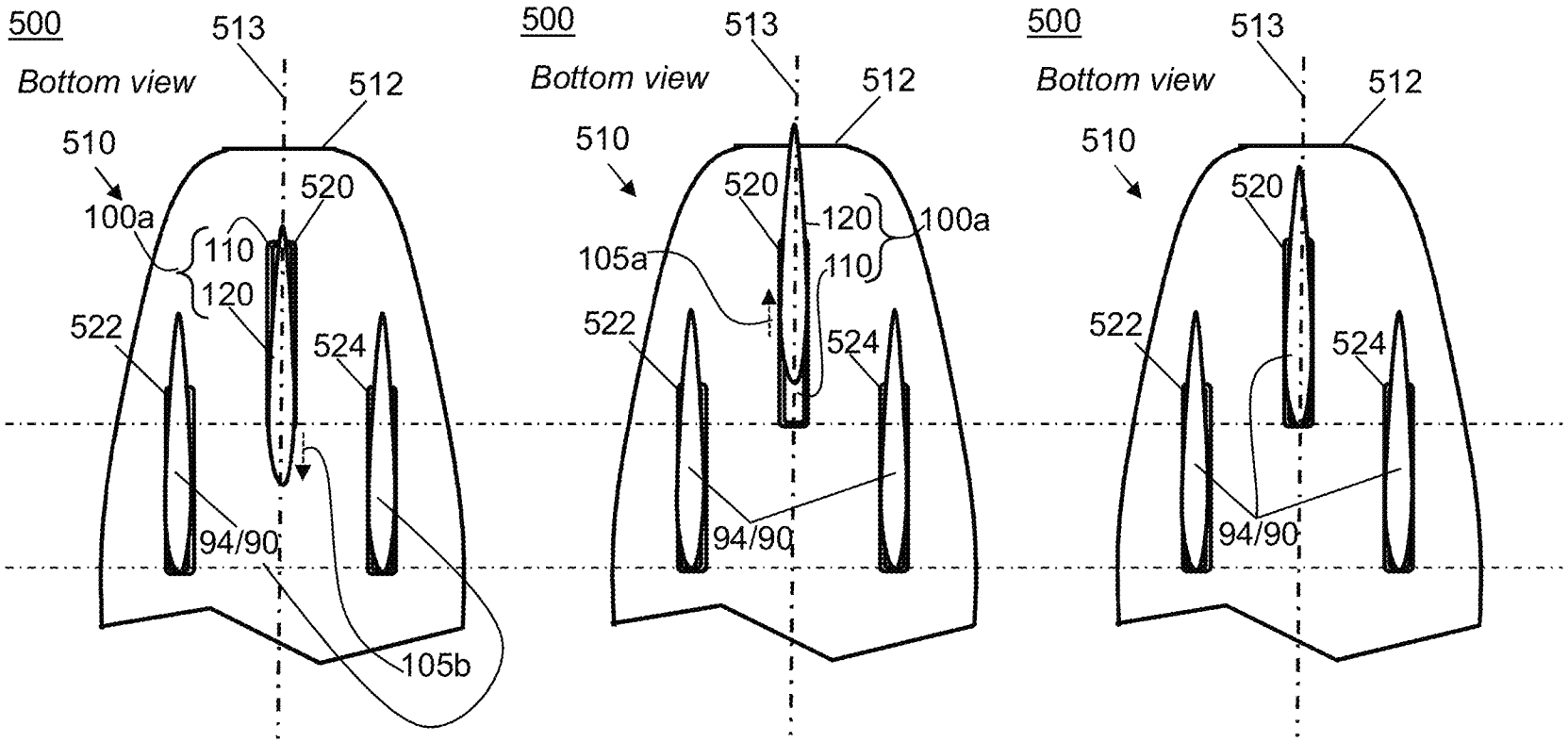

Reference is also made to FIG. 5C, 5F, 5I, which are schematic illustrations of the trailing portion of watersport board 500 and three typical prior art fins 90.

FIGS. 5A-5I show a schematic bottom view of the trailing portion of an elongated body 510 of watersport board 500, including a bottom surface 515, a trailing end 512 and a central longitudinal axis 513 extending between trailing end 512 and a leading end 511 of watersport board 500.

Watersport board 500 may include a central fin socket 520 (e.g., such as fin socket 220 described hereinabove), a first side fin socket 522 (e.g., such as first side fin socket 422 described hereinabove) and a second side fin socket 524 (e.g., such as second side fin socket 524 described hereinabove) formed on bottom surface 515 of elongated body 510 of watersport board 500. Central fin socket 520 may be disposed along central longitudinal axis 513 of elongated body 510 of watersport board 500. First side fin socket 522 and second side fin socket 524 may be disposed on opposing sides of central longitudinal axis 513 of elongated body 510 of watersport board 500.

In the examples of FIGS. 5A and 5B, offset-adapted fins 100 are mounted in all three fin sockets 520, 522, 524 of elongated body 510 of watersport 500.

In the example of FIG. 5A, blades 120 of central offset-adapted fin 100*a*, first side offset-adapted fin 100*b* and second side offset-adapted fin 100*c* are offset with respect to their respective connectors 110 in leading longitudinal offset direction 105*b*. In the example of FIG. 5A, blades 120 of central offset-adapted fin 100*a*, first side offset-adapted fin 100*b* and second side offset-adapted fin 100*c* mounted in fin sockets 520, 522, 524, respectively, are disposed farther from trailing end 512 of elongated body 510 of watersport board 500 than would be disposed blades 94 of typical prior art fins 90 if typical prior art fins 90 would have been mounted in fin sockets 520, 522, 524 of elongated body 510 of watersport 500 (e.g., as shown in FIG. 5A as compared to FIG. 5C).

In the example of FIG. 5B, blades 120 of central offset-adapted fin 100*a*, first side offset-adapted fin 100*b* and second side offset-adapted fin 100*c* are offset with respect to their respective connectors 110 in trailing longitudinal offset direction 105*a*. In the example of FIG. 5B, blades 120 of central offset-adapted fin 100*a*, first side offset-adapted fin 100*b* and second side offset-adapted fin 100*c* mounted in fin sockets 520, 522, 524, respectively, are disposed closer to trailing end 512 of elongated body 510 of watersport board 500 than would be disposed blades 94 of typical prior art fins 90 if typical prior art fins 90 would have been mounted in fin sockets 520, 522, 524 of elongated body 510 of watersport 500 (e.g., as shown in FIG. 5B as compared to FIG. 5C).

In the examples of FIGS. 5D and 5E, typical prior art fin 90 is mounted in central fin socket 520 and offset-adapted fins 100 are mounted in side fin sockets 522, 524.

In the example of FIG. 5D, blades 120 of first side offset-adapted fin 100*b* and second side offset-adapted fin 100*c* are offset with respect to their respective connectors 110 in leading longitudinal offset direction 105*b*. In the example of FIG. 5D, blades 120 of first side offset-adapted fin 100*b* and second side offset-adapted fin 100*c* mounted in fin sockets 522, 524, respectively, are disposed farther from trailing end 512 of elongated body 510 of watersport board 500 than would be disposed blades 94 of typical prior art fins 90 if typical prior art fins 90 would have been mounted in fin sockets 522, 524 of elongated body 510 of watersport 500 (e.g., as shown in FIG. 5D as compared to FIG. 5F).

In the example of FIG. 5E, blades 120 of first side offset-adapted fin 100*b* and second side offset-adapted fin 100*c* are offset with respect to their respective connectors 110 in trailing longitudinal offset direction 105*a*. In the example of FIG. 5E, blades 120 of first side offset-adapted fin 100*b* and second side offset-adapted fin 100*c* mounted in fin sockets 522, 524, respectively, are disposed closer to trailing end 512 of elongated body 510 of watersport board 500 than would be disposed blades 94 of typical prior art fins 90 if typical prior art fins 90 would have been mounted in fin sockets 522, 524 of elongated body 510 of watersport 500 (e.g., as shown in FIG. 5E as compared to FIG. 5F).

In the examples of FIGS. 5G and 5H, central offset-adapted fin 100*a* is mounted in central fin socket 520 and typical prior art fins 90 are mounted in first and second side fin sockets 522, 524, respectively.

In the example of FIG. 5G, blade 120 of central offset-adapted fin 100*a* is offset with respect to its connector 110 in leading longitudinal offset direction 105*b*. In the example of FIG. 5G, blade 120 of central offset-adapted fin 100*a* mounted in central fin sockets 520 is disposed farther from trailing end 512 of elongated body 510 of watersport board 500 than would be disposed blade 94 of typical prior art fin 90 if typical prior art fin 90 would have been mounted in central fin socket 520 of elongated body 510 of watersport 500 (e.g., as shown in FIG. 5G as compared to FIG. 5I).

In the example of FIG. 5H, blade 120 of central offset-adapted fin 100*a* is offset with respect to its connector 110 in trailing longitudinal offset direction 105*a*. In the example of FIG. 5H, blade 120 of central offset-adapted fin 100*a* mounted in central fin sockets 520 is disposed closer to trailing end 512 of elongated body 510 of watersport board 500 than would be disposed blade 94 of typical prior art fin 90 if typical prior art fin 90 would have been mounted in central fin socket 520 of elongated body 510 of watersport 500 (e.g., as shown in FIG. 5H as compared to FIG. 5I).

In some embodiments, in a watersport board having two or more fin sockets, one offset adapted fin 100 may be mounted in one of the two or more fin sockets while at least one typical prior art fin may be mounted in the other at least one fin socket of the two or more fins sockets of the watersport board.

While offset-adapted fins 100 are embodied as one type of fins for watersport boards "futures fin" type), offset-adapted fin 100 may include any type of fins known in the art such as "FCS II fins" and/or "US Box fins".

Figure 6B:
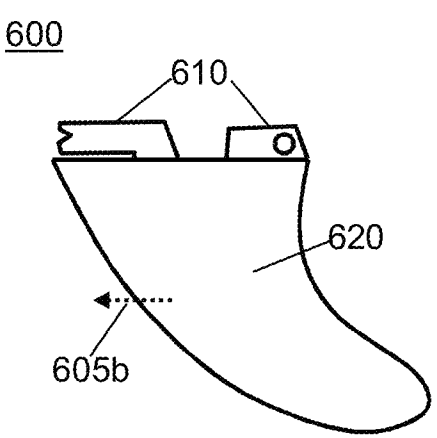
FIGS. 6A and 6B are schematic illustrations of an offset-adapted fin of "FCS II fins" type, according to some embodiments of the invention.
Figure 6C:
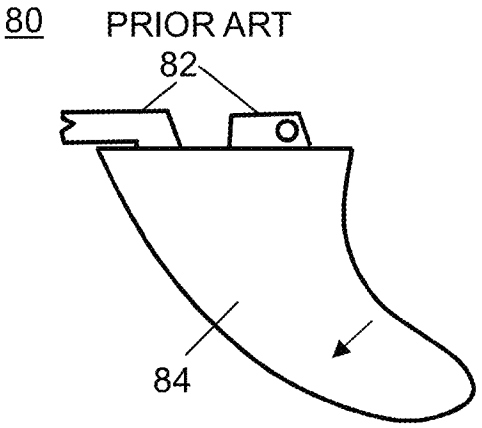
FIG. 6C is a schematic illustration of a typical prior art fin of "FCS II fins" type.
Figure 6A:
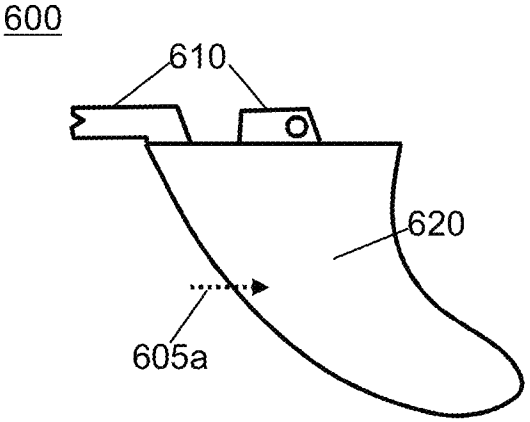

Reference is made to FIGS. 6A and 6B, which are schematic illustrations of an offset-adapted fin 600 of "FCS II fins" type, according to some embodiments of the invention.

Reference is also made to FIG. 6C, which is a schematic illustration of a typical prior art fin 80 of "FCS II fins" type. Typical prior art fin 80 has a connector 82 and a blade 84.

FIG. 6A shows offset-adapted fin 600 whose blade 620 is offset in longitudinal trailing offset direction 605*a* with respect to its connector 610 (e.g., as shown in FIG. 6A as compared to FIG. 6C). FIG. 6B shows offset-adapted fin 600 whose blade 620 is offset in longitudinal leading offset direction 605*b* with respect to its connector 610 (e.g., as shown in FIG. 6B as compared to FIG. 6C).

Figure 7A:
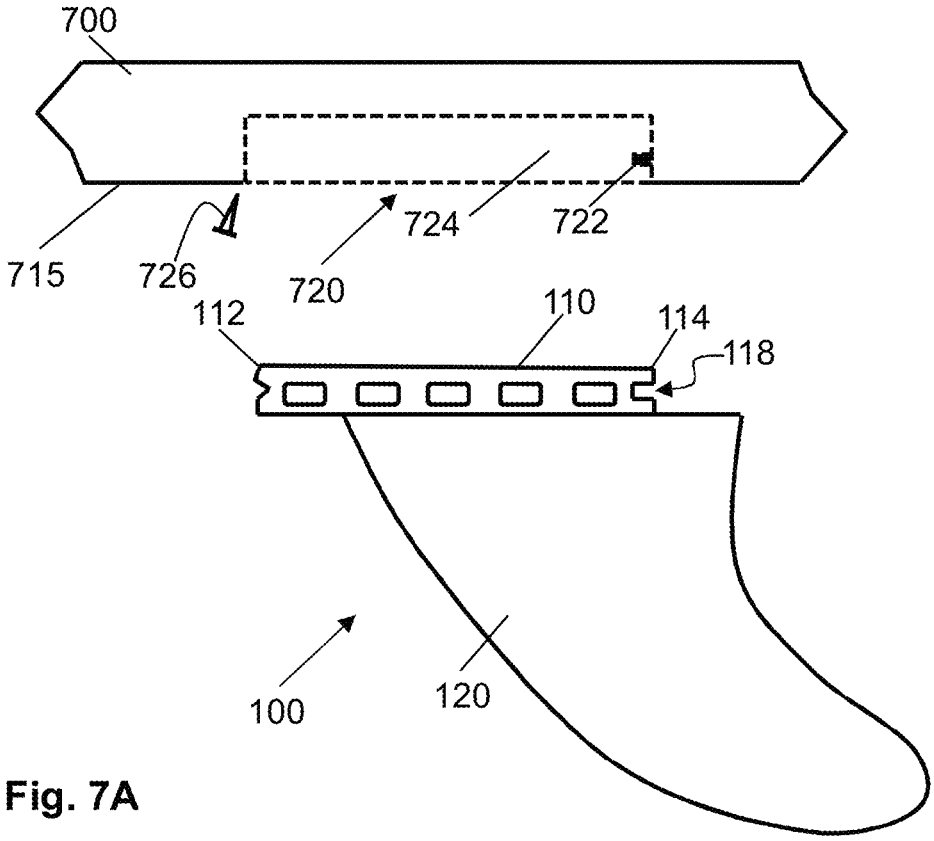
FIGS. 7A and 7B are schematic illustrations of a portion of a watersport board having a fin socket on its bottom surface, and of the offset-adapted fin, according to some embodiments of the invention.
Figure 7B:
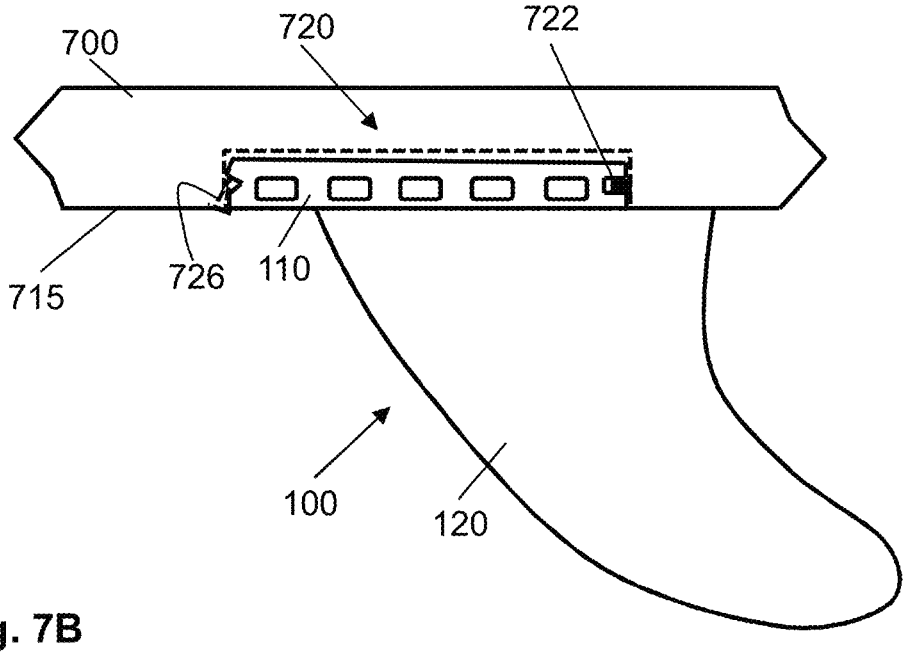

Reference is made to FIGS. 7A and 7B, which are schematic illustrations of a portion of a watersport board 700 having a fin socket 720 on its bottom surface 715, and of offset-adapted fin 100, according to some embodiments of the invention.

FIG. 7A shows offset-adapted fin 100 externally to fin socket 720 and FIG. 7B shows offset-adapted fin 100 mounted in fin socket 720.

Fin socket 720 may include a protrusion 722 projecting into interior 744 of fin socket 720. Protrusion 722 may engage a dent or cut 118 formed on a connector 110 of offset-adapted fin 100 (e.g., on trailing end 114 as shown in FIGS. 7A and 7B; or at any other suitable location along connector 110, e.g. depending on the type of offset-adapted fin) when connector 110 of offset-adapted fin 100 is mounted in fin socket 720. Once mounted in fin socket 720, connector 110 of offset-adapted fin 100 may be further secured (e.g., at leading end 112 as shown in FIGS. 7A and 7B; or at any other suitable location along connector 110, e.g., depending on the type of offset-adapted fin) using a fastener 724 (e.g., a screw and/or any other suitable fastener).

Figure 8:
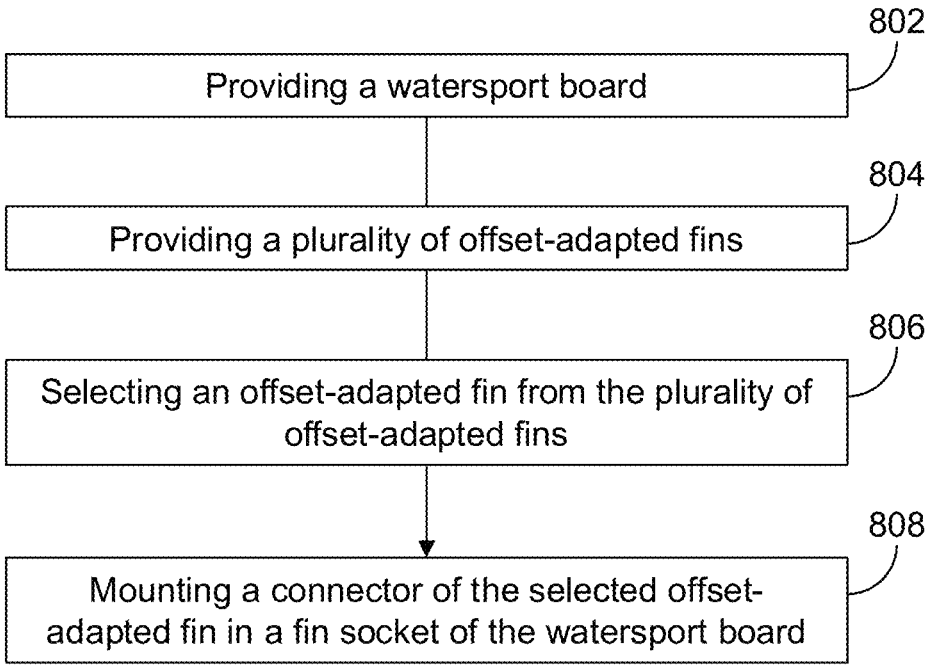
FIG. 8 is a flowchart of a method of aligning a watersport board, according to some embodiments of the invention.

Reference is made to FIG. 8, which is a flowchart of a method of aligning a watersport board, according to some embodiments of the invention.

In operation 802, a watersport board may be provided (e.g., by the user). The watersport board may include a fin socket. The fin socket may be disposed at a fixed distance relative to a trailing end of the watersport board (e.g., as described hereinabove).

In operation 804, a plurality of offset-adapted fins (e.g., such as set 300 of offset-adapted fins 100 described hereinabove) may be provided (e.g., by the user). Each offset-adapted fin of the plurality of offset-adapted fins may include a connector that may be mounted in the fin socket of the watersport board and a blade attached to the connector and being offset with respect to the connector in a longitudinal offset direction by an offset distance. The offset distance, the longitudinal offset direction or both of at least one offset-adapted fin of the plurality of offset-adapted fins may be different from the offset distance, the longitudinal offset direction or both of at least one another offset-adapted fin of the plurality of offset-adapted fins.

In operation 806, an offset-adapted fin may be selected (e.g., by the user) from the plurality of offset-adapted fins based on a desired distance of the blade of the selected offset-adapted fin from the trailing end of the watersport board. The desired distance of the blade of the selected offset-adapted fin from the trailing end of the watersport board may be selected (e.g., by the user) based on a desired performance (a desired stability, a desired speed and/or a desired turnability) of the watersport board. The desired distance of the blade of the selected offset-adapted fin from the trailing end of the watersport board may be selected (e.g., by the user) based on user parameters (e.g., a height of the user, a weight of the user and/or a skill of the user) and/or wind conditions and/or waves conditions.

In operation 808, the connector of the selected offset-adapted fin may be mounted (e.g., by the user) in the fin socket of the watersport board.

The offset-adapted fins (e.g., such as offset-adapted fins 100, 600 described hereinabove) according to embodiments of the present invention may allow adjusting the position of the blades of the fins in the watersport board having fixed fins sockets without a reconfiguration of the watersport board, which is typically mechanically complex and expensive. The offset-adapted fins according to embodiments of the present invention may be used in "Channel Islands Surfboards", "Pyzel Surfboards", "Sharp Eye Surfboards" and/or any other suitable type watersport boards. The offset-adapted fins according to embodiments of the present invention may be used with watersport boards having any number of fin sockets, for example one fin socket, two fin sockets, three fin sockets and/or five fins sockets. The offset-adapted fins according to embodiments of the present invention may be embodied "futures fins", "FCS II fins" and/or "US Box fins" and/or as any other suitable type of fins.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

Although embodiments of the invention are not limited in this regard, the terms "plurality" and "a plurality" as used herein can include, for example, "multiple" or "two or more". The terms "plurality" or "a plurality" can be used throughout the specification to describe two or more components, devices, elements, units, parameters, or the like. The term set when used herein can include one or more items.

The invention is not limited to those diagrams or to the corresponding descriptions. For example, flow need not move through each illustrated box or state, or in exactly the same order as illustrated and described. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A set of offset-adapted fins for a surfboard, the set comprising:

a plurality of offset-adapted fins, each offset-adapted fin of the plurality of offset-adapted fins comprising:

a connector configured to be mounted in a fin socket of the surfboard, and a blade attached to the connector, wherein the blade and the connector are formed integrally of one piece of material so that the blade is unmovably attached to the connector, and wherein the blade is offset with respect to the connector in a longitudinal offset direction by an offset distance;

wherein the offset distance, the longitudinal offset direction or both of at least one offset-adapted fin of the plurality of offset-adapted fins is different from the offset distance, the longitudinal offset direction or both of at least one another offset-adapted fin of the plurality of offset-adapted fins;

wherein at least two offset-adapted fins of the plurality of offset-adapted fins have the same offset distance and different longitudinal offset directions.

2. The set of claim 1, wherein at least two offset-adapted fins of the plurality of offset-adapted fins have the same offset distance.

3. The set of claim 1, wherein at least two offset-adapted fins of the plurality of offset-adapted fins have the same longitudinal offset direction.

4. The set of claim 1, wherein at least two offset-adapted fins of the plurality of offset-adapted fins have the same offset distance and the same longitudinal offset direction.

5. The set of claim 1, wherein at least two offset-adapted fins of the plurality of offset-adapted fins have the same longitudinal offset direction and different offset distances.

6. A surfboard comprising the set of claim 1.

* * * * *